US007399382B2

(12) United States Patent
Bartelmuss et al.

(10) Patent No.: US 7,399,382 B2
(45) Date of Patent: Jul. 15, 2008

(54) DEVICE FOR CLEANING A ROLL IN A PAPER PRODUCTION PLANT

(76) Inventors: Klaus Bartelmuss, Nummer 63, Teufenbach (AT) A-8833; Heinz Bartelmuss, Nummer 63, Teufenbach (AT) A-8833

( * ) Notice: Subject to any disclaimer, the term of this patent is extended or adjusted under 35 U.S.C. 154(b) by 556 days.

(21) Appl. No.: 10/924,311

(22) Filed: Aug. 23, 2004

(65) Prior Publication Data

US 2005/0076464 A1 Apr. 14, 2005

(30) Foreign Application Priority Data

Oct. 13, 2003 (AT) ..... A 1608/2003

(51) Int. Cl.
*D21G 3/00* (2006.01)

(52) U.S. Cl. ..... 162/272; 15/256.51; 15/256.5; 162/281; 100/163 R; 100/174

(58) Field of Classification Search ..... 162/272; 15/256.51, 256.5; 100/163 R, 174
See application file for complete search history.

(56) References Cited

U.S. PATENT DOCUMENTS 1,415,859 A * 5/1922 Bates ..... 15/256.51
1,786,587 A * 12/1930 Wenzel ..... 100/174
2,318,504 A * 5/1943 Lodding ..... 15/256.53
3,584,570 A * 6/1971 Krefeld ..... 100/163 R

* cited by examiner

*Primary Examiner*—Mark Halpern
(74) *Attorney, Agent, or Firm*—Laurence A. Greenberg; Werner H. Stemer; Ralph E. Locher

(57) ABSTRACT

A device for cleaning a roll in a paper production plant has a doctor blade assigned to the surface of the roll. The doctor blade is mounted such that it can be pivoted with respect to the roll by two bearing journals that are aligned parallel to the axis of the roll. An actuating lever for pivoting the doctor blade is fixed to at least one of the two bearing journals. The bearing journal and the actuating lever are formed with mutually associated latching elements, by way of which the bearing journal and the actuating lever can be connected to each other in form-lock in different positions.

12 Claims, 5 Drawing Sheets

DEVICE FOR CLEANING A ROLL IN A PAPER PRODUCTION PLANT

BACKGROUND OF THE INVENTION

Field of the Invention

The present invention relates to a device for cleaning a roll in a paper production plant. The device has a doctor blade which is assigned to the surface of the roll and which is mounted such that it can be pivoted with respect to the roll by means of two bearing journals aligned parallel to the axis of the roll. An actuating lever, by means of which the doctor blade can be pivoted, is affixed to at least one of the two bearing journals.

Known such devices are used to remove contaminants, in particular in the form of fibers, found on the surfaces of rolls in paper production plants. In this way, the proper functionality of the rolls up to specification and meeting the requirements is ensured.

In this case, the doctor blade is fixed to a doctor bar that extends over the length of the roll. At its two ends, the doctor bar is formed with bearing journals, by means of which it can be rotated in bearings. Furthermore, the bearings can be adjusted transversely with respect to the axis of rotation of the roll.

In order to be able to pivot the doctor bar, in addition, on each side of the roll, an actuating lever is provided, which is connected to the associated bearing journal. By means of pivoting the actuating lever, the bearing journals can be rotated, by which means the doctor bar with the doctor blade can be adjusted with respect to the surface of the roll. Adjustment of the doctor blade with respect to the surface of the roll is required, firstly, if the doctor blade is to be replaced and is required, secondly, if the angle of attack of the doctor blade is to be changed.

It has become known to connect the actuating lever to the respective bearing journal by the actuating lever being clamped to the bearing journal by means of screws. After the screws have been loosened, the bearing journal can be rotated with respect to the actuating lever, which means that the angular position of the doctor blade can be adjusted. Although, by means of a force-fitting connection of this type of the actuating lever to the bearing journal, adjustment of the doctor bar can be achieved in a straightforward manner, this connection is disadvantageous since, because of the torques which occur during operation and which act on this connection, undesired displacement of the doctor blade with respect to the bearing journal can take place.

In order to avoid this disadvantage, it is also known to form the actuating levers and the bearing journals with grooves which are associated with one another and into which a key is inserted. By means of such a form-fitting connection, the actuating levers and the bearing journals are connected to one another in a predefined rotational position, which cannot change during operation. The disadvantage of this connection, however, lies in the fact that no adjustment of the rotational position of the rotary journals with respect to the actuating levers is possible in order in this way to effect presetting of the pivoted position of the doctor bar.

SUMMARY OF THE INVENTION

It is accordingly an object of the invention to provide a device for cleaning a roll in a paper-making plant which overcomes the above-mentioned disadvantages of the heretofore-known devices and methods of this general type and which provides for a connection between the actuating lever and the associated bearing journal in a form-lock, thus ruling out undesired displacement, yet, irrespective of this, to allow for the possibility of adjusting the rotational position of the bearing journal with respect to the actuating lever in accordance with the technical requirements.

With the foregoing and other objects in view there is provided, in accordance with the invention, a device for cleaning a roll in a paper production plant, comprising:

a doctor blade assigned to a surface of the roll and pivotally mounted for pivoting with respect to the roll about two bearing journals extending parallel to an axis of the roll; and an actuating lever mounted to at least one of the bearing journals for pivoting the doctor blade;

the actuating lever and the at least one bearing journal being formed with mutually associated latching elements configured to connect the bearing journal and the actuating lever to one another with a form-lock in a plurality of mutually different positions.

In other words, the objects of the invention are achieved in that the bearing journal and the actuating lever are formed with mutually associated latching elements, by means of which the bearing journal and the actuating lever can be connected to each other in a form-lock, i.e., in a form-fitting manner, in different positions.

The actuating lever is preferably formed with a two-part clamping sleeve, by means of which the two parts can be connected rigidly to each other, at least one of the two parts being formed with profiling on its inner side. In this case, in particular the sleeve part that can be fixed detachably to the actuating lever is formed with profiling on its inner side. Furthermore, in particular the two sleeve parts can be connected rigidly to each other by means of bolts. The profiling is preferably formed by ribs or grooves, in particular by tooth systems, aligned parallel to the axis of the bearing journal.

According to a preferred embodiment, the bearing journal is formed with an additional component which is formed with profiling on its surface, in particular with a tooth system, that is a ratchet spine system. In this case, the additional component can be located in the region of a flat or a recess belonging to the bearing journal.

Other features which are considered as characteristic for the invention are set forth in the appended claims.

Although the invention is illustrated and described herein as embodied in a device for cleaning a roll in a and paper production plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
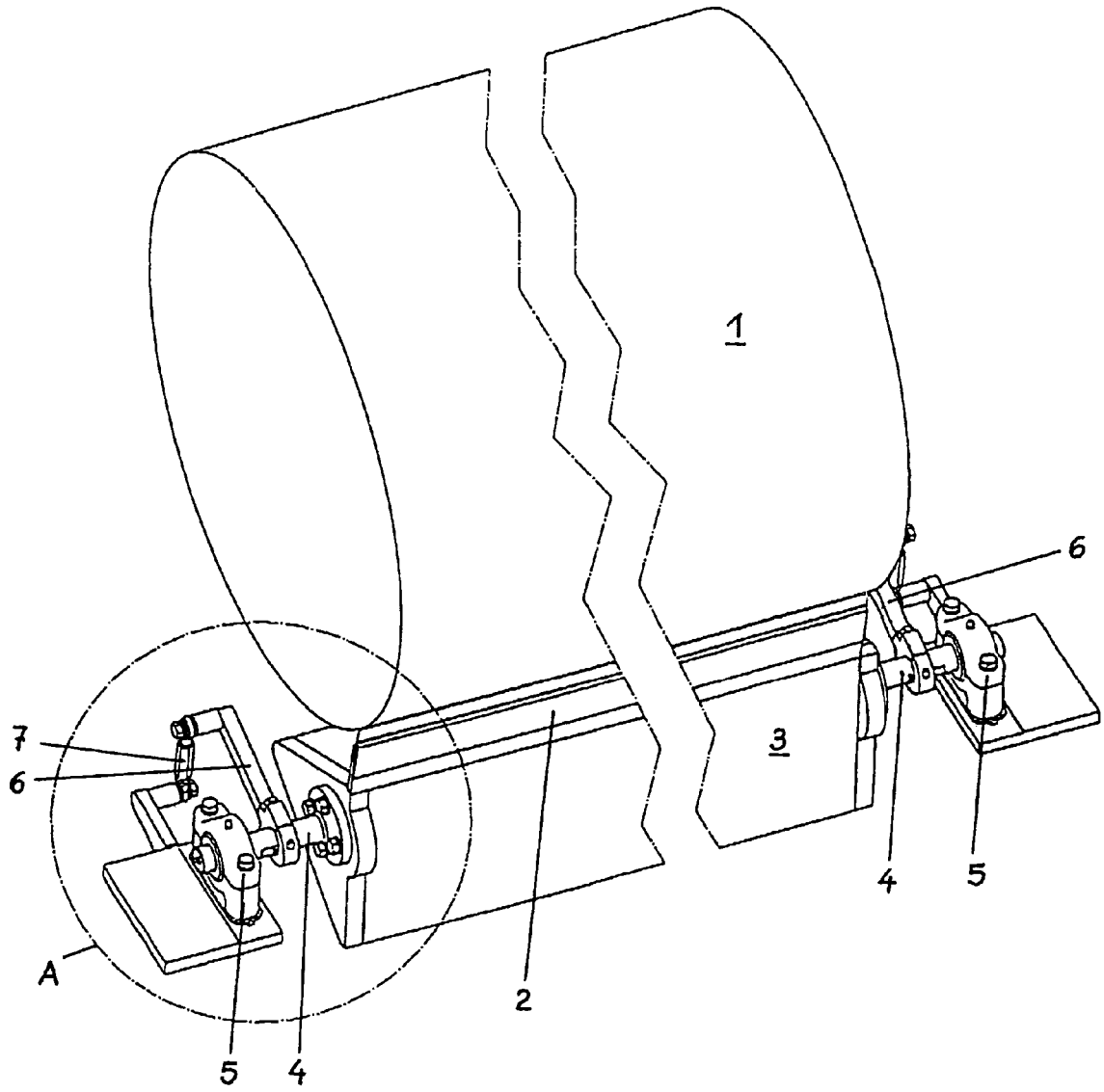
FIG. 1 is an axonometric view of a roll in a paper production plant and a doctor blade assigned thereto which is formed with an actuating device.

Referring now to the figures of the drawing in detail and first, particularly, to FIG. 1 thereof, there is shown a roll 1 in a paper production plant, which is assigned a doctor blade 2 or scraper 2. The doctor blade 2 is disposed on a doctor bar 3 which extends parallel to the axis of the roll 1 over its entire length. At both its ends, the doctor bar 3 is formed with bearing journals 4 that are disposed in bearings 5. Actuating levers 6 are fixed to the bearing journals 4. The levers 6 can be pivoted about the axis of the bearing journals 4 via actuating drives 7. The rotation of the bearing journals 4 and the pivoting of the doctor bar 3 and the doctor blade 2 with respect to the surface of the roll 1 are effected in this way. Since, in addition, the bearings 5 can be adjusted transversely with respect to the roll 1, the angle of attack of the doctor blade 2 with respect to the roll 1 can also be set in this way.

Figure 2:
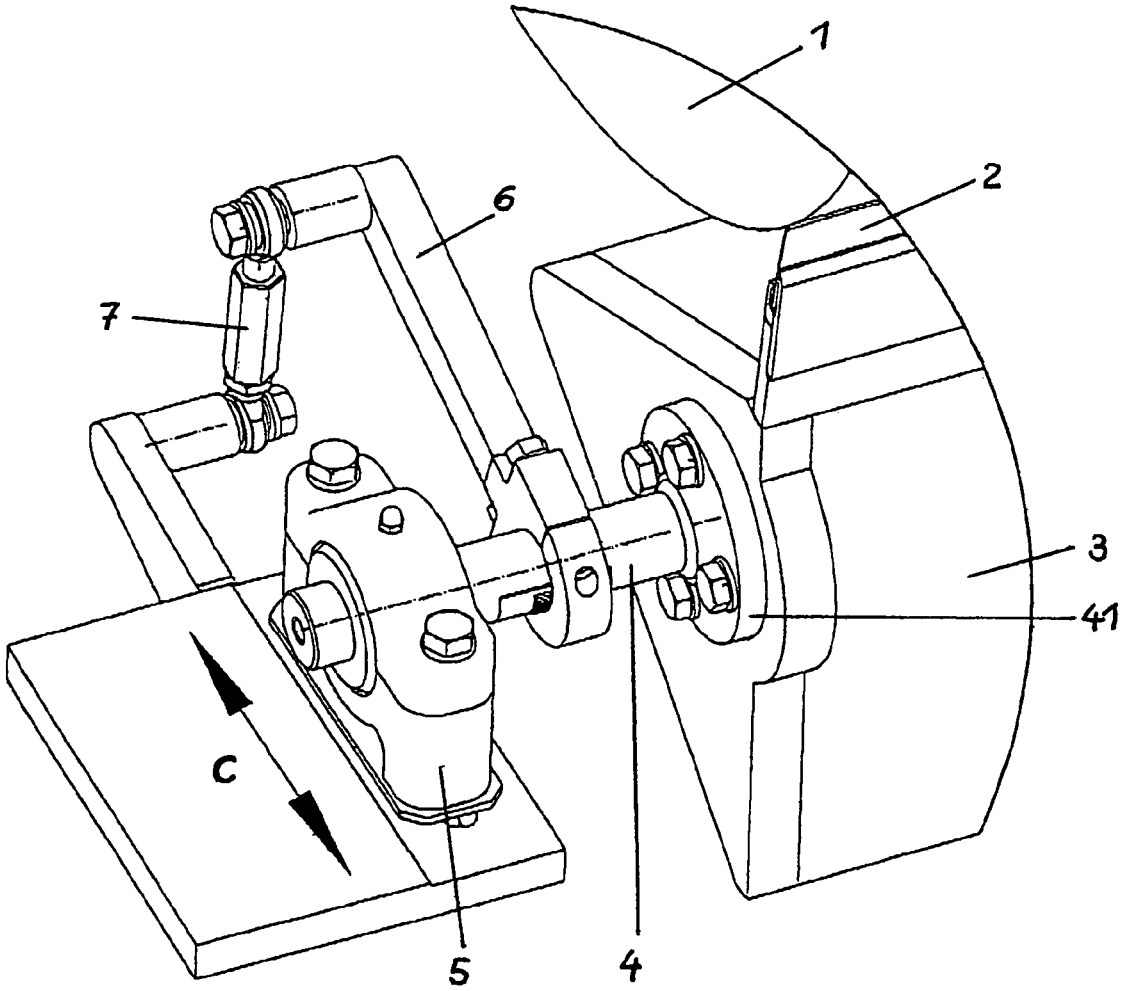
FIG. 2 is an enlarged illustration of the detail A in FIG. 1.
Figure 3:
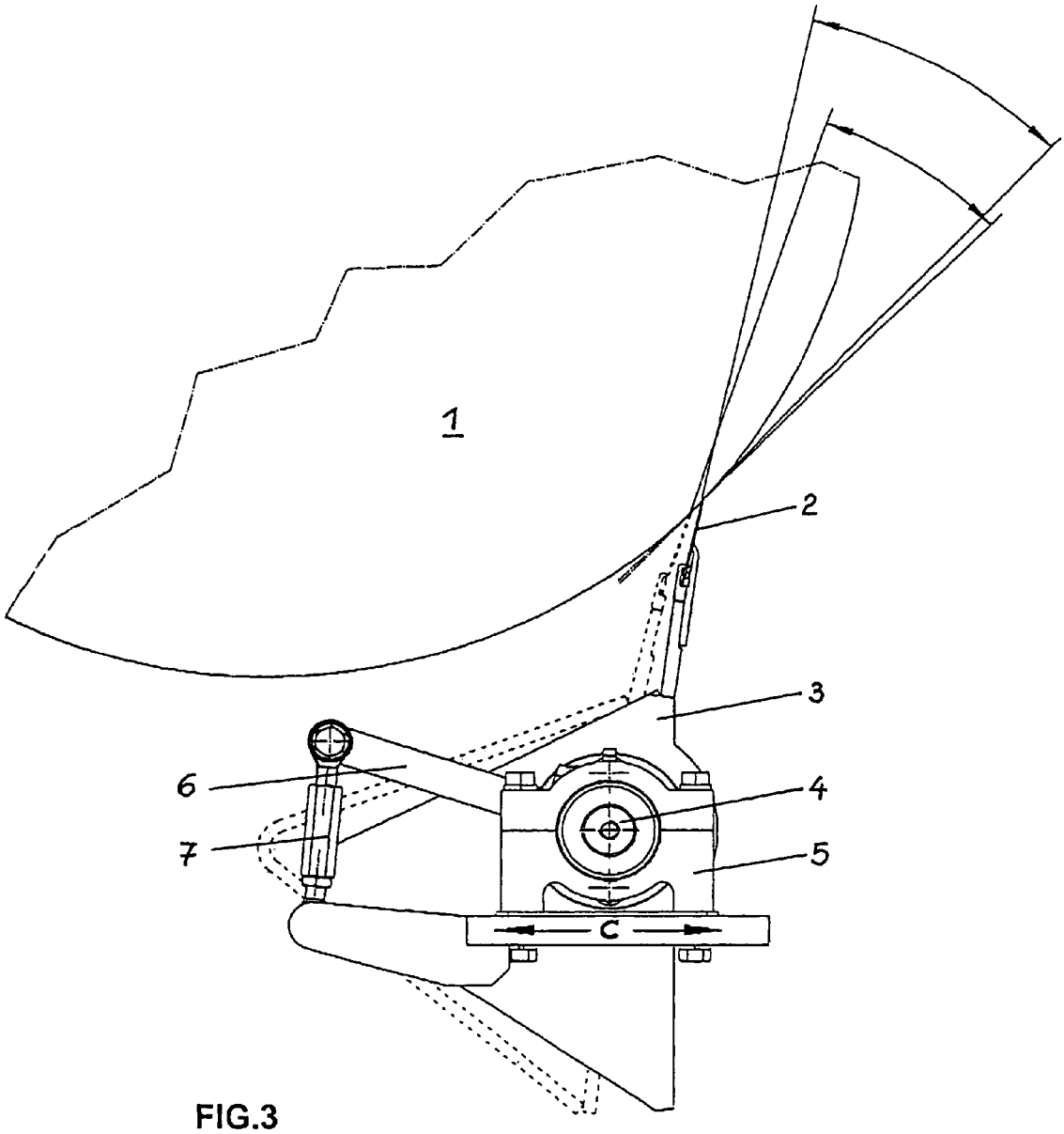
FIG. 3 is a side view of the roll and the doctor blade with the actuating device.

In FIG. 2, the left-hand end of the roll 1, the doctor blade 2, the doctor bar 3, the left-hand bearing journal 4, the associated bearing 5, the left-hand actuating lever 6, the left-hand actuating device 7 and a flange 41 to which the doctor bar 3 is screwed are illustrated. The bearing 5 can be adjusted with respect to the roll 1 in the direction of the double arrow C. The actuating device 7 is formed by an actuating screw or by an actuating cylinder. As a result of actuation of the actuating device 7, the actuating lever 6 is pivoted and the bearing journal 4 is rotated. In this way, the doctor bar 3 with the doctor blade 2 is pivoted with respect to the roll 1. By means of adjustment of the bearing 5, the doctor blade 2 can be brought into contact with the roll 1. In this regard, reference is also made to the illustration of FIG. 3, in which different actuating angles of the doctor blade 2 are indicated.

Figure 4:
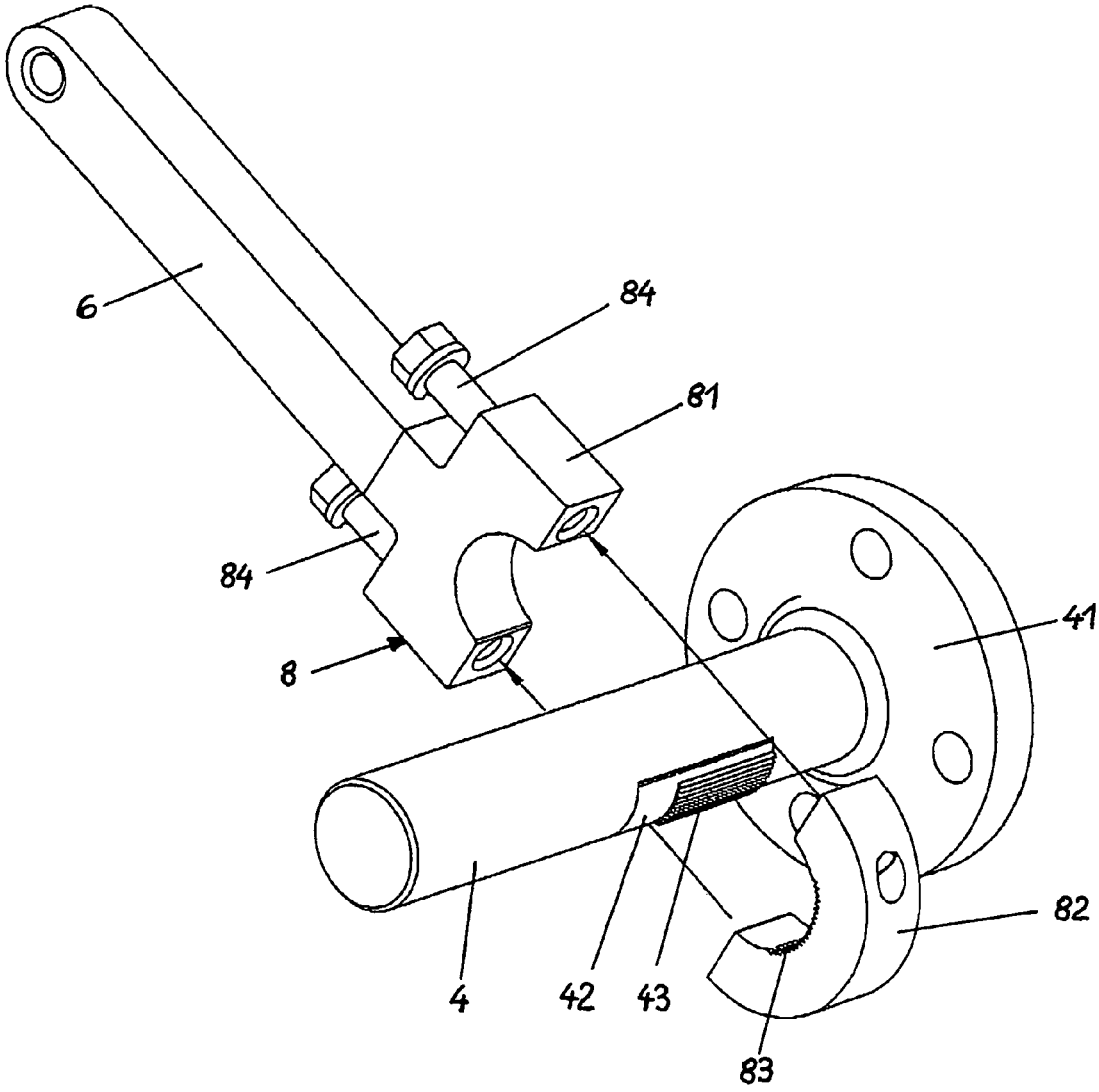
FIG. 4 is a perspective, exploded view of a detail of FIG. 3.

As illustrated in FIG. 4, the actuating lever 6 is formed with a clamping sleeve 8, which comprises two parts 81 and 82 that can be connected to each other by means of two screws 84. The clamping sleeve 8 is used to connect the actuating lever 6 to the associated bearing journal 4 in a form-fitting manner (form-lock, positive connection), in order in this way to ensure a rigid connection between the actuating lever 6 and the doctor bar 3.

This connection consists in the part 82 being formed on its inner side with a tooth system 83—an inner spline 83—formed parallel to the axis of rotation of the bearing journal 4, which is assigned an opposite tooth system 43—an external spline 43—on the bearing journal 4. In this case, the spline 43 extends over approximately twice the angle as compared with the tooth system 83. The two tooth systems or splines 43, 83 form a positive lock, or form-lock between the bearing journal 4 and the doctor bar 3. It is noted, in this context, that a form-locking (i.e., positive) connection is one that connects two elements together due to the shape of the elements themselves, as opposed to a force-locking (i.e., frictional) connection, which locks the elements together by force external to the elements.

Figure 5:
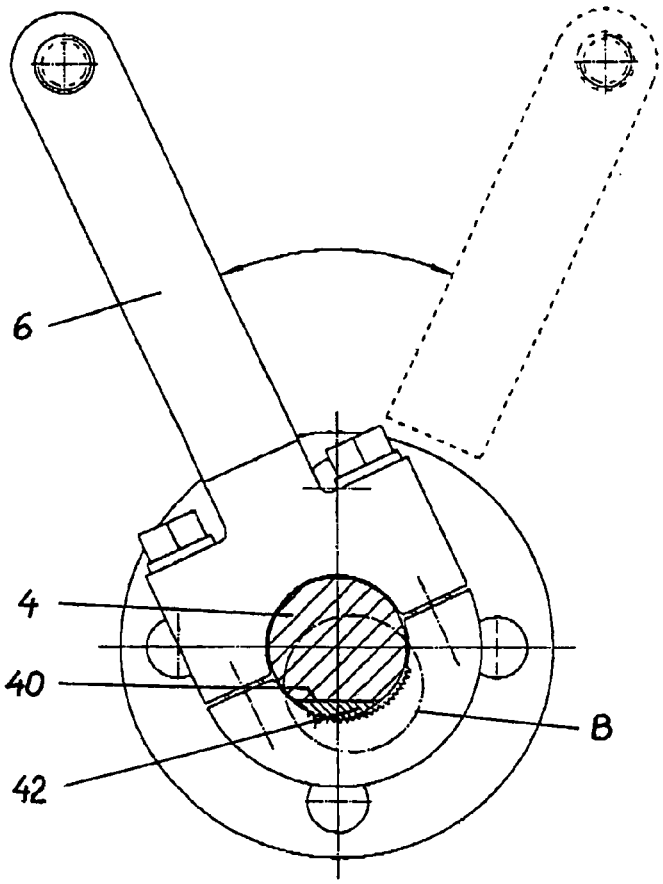
FIG. 5 is an elevational side view of the connection of the actuating lever to the bearing journal.
Figure 6:
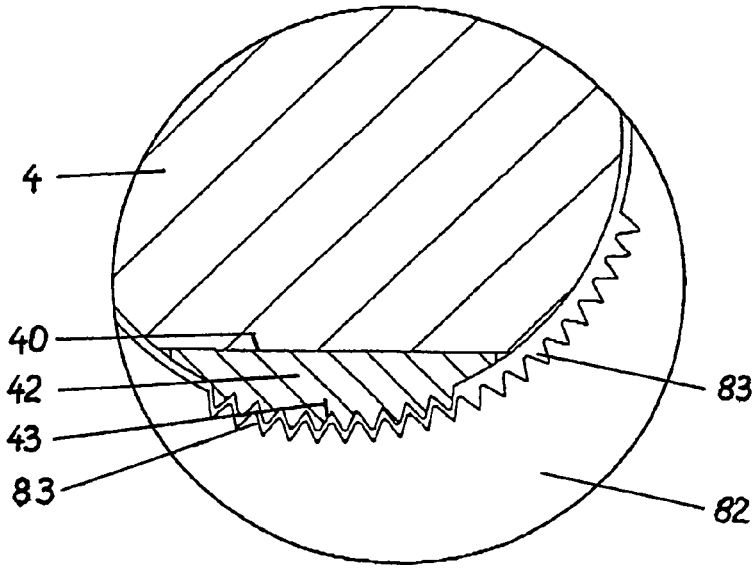
FIG. 6 is an enlarged illustration of the detail B in FIG. 5.

As can be seen from FIGS. 5 and 6, the tooth system 43 of the journal 4 is produced by the journal 4 being formed with a flat 40, which is assigned a supporting part 42 that is formed with the tooth system 43. This formation is particularly advantageous inasmuch as a flat on the bearing journal 4 can be produced in a very straightforward manner. It is merely necessary for the supporting part 42, which is formed as a section of a circle in cross section and is formed with the tooth system 43 on its outer face, to be fitted to this flat.

In order to be able to replace the doctor blade 2, the doctor bar 3 is pivoted. In order to be able to set the pivoted position of the doctor blade 2 with respect to the roll 1, the two sleeve parts 81 and 82 are detached from each other, which means that the tooth system 83 can be released from the tooth system 43. The bearing journal 4 can then be rotated, by which means the angular position of the doctor blade 2 with respect to the roll 1 is changed. The two sleeve parts 81 and 82 are then screwed to each other by means of the screws 84, by which means the tooth systems 83 and 43 are latched with each other and a form-fitting connection is achieved. Thus, by loosening the screws 84 and rotating the bearing journal 4, the change in the angle of attack of the doctor blade 2 with respect to the roll 1 can be effected in a straightforward manner.

As can be seen from FIG. 5, in this way setting of the connection between the bearing journal 4 and the actuating lever 6 can be effected over an angular range of, say, 50°.

This application claims the priority, under 35 U.S.C. § 119, of Austrian patent application No. A 1608/2003, filed Oct. 13, 2003; the entire disclosure of the prior application is herewith incorporated by reference.

We claim:

1. A device for cleaning a roll in a paper production plant, comprising:

a doctor blade assigned to a surface of the roll and pivotally mounted for pivoting with respect to the roll about two bearing journals extending parallel to an axis of the roll; and an actuating lever mounted to at least one of said bearing journals for pivoting said doctor blade;

said actuating lever and said at least one bearing journal being formed with mutually associated latching elements configured to connect said bearing journal and said actuating lever to one another with a form-lock in a plurality of mutually different angular positions of said actuating lever relative to said bearing journal and engaging and meshing with one another in each of the plurality of mutually different angular positions.

2. The device according to claim 1, wherein said actuating lever is formed with a two-part clamping sleeve having two parts disposed to embrace said bearing journal, at least one of said two parts is formed with profiling on an inner side thereof and meshing with said bearing journal, and said two parts are rigidly connectible to one another.

3. The device according to claim 2, wherein said two parts are configured for rigid connection to one another by way of bolts.

4. The device according to claim 2, wherein said profiling is formed by ribs or grooves, aligned parallel to the axis of the bearing journal.

5. The device according to claim 2, wherein said profiling is formed by tooth systems.

6. The device according to claim 1, which comprises a sleeve part detachably affixable to said actuating lever and formed with profiling on an inner side thereof.

7. The device according to claim 6, wherein said sleeve part is configured for rigid connection to said actuating lever with bolts.

8. The device according to claim 1, wherein said bearing journal is formed with an additional component having profiling on a surface thereof.

9. The device according to claim 8, wherein said profiling of said additional component is a tooth system.

10. The device according to claim 8, wherein said additional component is disposed in a flattened region of said bearing journal.

11. The device according to claim 8, wherein said additional component is disposed in a recess formed on said bearing journal.

12. A device for cleaning a roll in a paper production plant, comprising:

a doctor blade assigned to a surface of the roll and pivotally mounted for pivoting with respect to the roll about two bearing journals extending parallel to an axis of the roll; and an actuating lever mounted to at least one of said bearing journals for pivoting said doctor blade;

said actuating lever and said at least one bearing journal being formed with mutually associated latching elements configured to connect said bearing journal and said actuating lever to one another with a form-lock in a plurality of mutually different angular positions, wherein said latching elements define a ratchet spine system effective to lock said activating lever relative to said bearing journal in any of the angular positions, with said latching elements engaging and meshing with one another in each of the plurality of mutually different angular positions.

* * * * *